US005788100A

United States Patent [19]

Sturk

[11] Patent Number: 5,788,100

[45] Date of Patent: Aug. 4, 1998

[54] CLOSURE WITH TWO POSITION LOCK RING

[76] Inventor: Ron Sturk, 38 Lorne Avenue, Brampton, Ontario, Canada, L6X 1L1

[21] Appl. No.: 673,028

[22] Filed: Oct. 10, 1996

Related U.S. Application Data

[63] Continuation of Ser. No. 329,872, Oct. 27, 1994, abandoned.

[30] Foreign Application Priority Data

Oct. 27, 1993 [GB] United Kingdom ..... 9322113

[51] Int. Cl.[6] ..... B65D 49/12

[52] U.S. Cl. ..... 215/258; 215/253; 215/274; 220/266; 220/270; 220/153.06; 220/529; 220/541.9

[58] Field of Search ..... 215/258, 274, 215/253; 220/319, 265–269, 270, 465; 222/530, 529, 537, 538, 541, 153, 541.6, 541.5, 541.9, 153.06

[56] References Cited

U.S. PATENT DOCUMENTS

| | | | |
|---|---|---|---|
| 2,774,523 | 12/1956 | Reike | 222/538 |
| 3,567,061 | 3/1971 | Song | 222/541 X |
| 3,693,820 | 9/1972 | Linkletter | 215/274 X |
| 3,971,488 | 7/1976 | McRoskey et al. | 215/274 X |
| 4,073,398 | 2/1978 | Schultz | 215/274 X |
| 4,105,141 | 8/1978 | Lane et al. | 222/153.06 X |
| 4,146,148 | 3/1979 | Dwindell et al. | 220/270 |
| 4,171,749 | 10/1979 | Obrist et al. | 222/541 X |
| 4,294,382 | 10/1981 | Summers et al. | 222/541 X |
| 4,461,390 | 7/1984 | Czaszar | 215/258 X |
| 4,509,654 | 4/1985 | Maguire | 215/258 X |
| 4,535,904 | 8/1985 | O'Connor et al. | 215/258 X |
| 4,555,048 | 11/1985 | Hamman et al. | 215/258 X |
| 4,651,885 | 3/1987 | Gach | 222/541 X |
| 5,197,619 | 3/1993 | Margaria | 215/258 X |
| 5,249,695 | 10/1993 | Luch et al. | 220/265 X |
| 5,348,183 | 9/1994 | Luch et al. | 215/253 X |

FOREIGN PATENT DOCUMENTS

| | | | |
|---|---|---|---|
| 688534 | 3/1953 | United Kingdom | 222/529 |

*Primary Examiner*—Allan N. Shoap
*Assistant Examiner*—Robin A. Hylton
*Attorney, Agent, or Firm*—Eugene J. A. Gierczak

[57] ABSTRACT

In a closure for a container having an opening presenting an upstanding circular bead, said closure comprising: a closure body presenting a spout for dispensing liquids from said container, said spout including an annular recess for releasable securement to said bead; a cap releasably securable to said spout; a lock ring frangibly connected to said cap, said lock ring aligned with said closure body, said annual recess and said bead, said lock ring frangibly breakable from said cap to lock said closure body to said container.

13 Claims, 9 Drawing Sheets

CLOSURE WITH TWO POSITION LOCK RING

This is a continuation of application Ser. No. 08/329,872, filed Oct. 27 1994, now abandoned.

FIELD OF INVENTION

This invention relates to a locking ring connected to a cap by a breakable web, and in particular relates to a closure for a container having a spout utilizing a cap with a locking ring connected to the cap by a frangible web.

BACKGROUND OF THE INVENTION

Various containers for containing or holding and shipping products, particularly liquids, have heretofore been manufactured and sold. Such containers may have caps or closures installed for the purpose of dispensing the liquid content through the closure. Moreover, such closures may include pull-up style pour spouts made of flexible materials or the like. Such threaded caps and plastic pull-up pour spouts are well known for containing liquids as well as facilitating dispensing liquid products from the container. The top of the container or the container cover may be manufactured with the hole for subsequent installation of the closure. Such prior art closures are typically threaded, crimped with a metal lock ring or ultrasonically welded or pressed into an interference fit onto the container cover. A plastic lock ring may or may not be used in such devices. Moreover, such closures may incorporate tamper evidence or child-resistant features.

For example, U.S. Pat. No. 4,146,148 relates to a frangible closure for containers consisting of a molded plastic closure sealing member and a metal crimping ring. The closure sealing member has a central tear out membrane surrounded by a sealing annulus with an annular weakened tearing zone interposed therebetween. The tear out membrane has a short cylindrical skirt depending from its lower surface and an enlarged ring pull projecting from its upper surface. The metal crimping ring overlies the sealing annulus for tight securement to a container wall opening neck. An upward force applied to the ring pull tears away the centre membrane which can be then employed to re-close the opening after partial decanting of the container.

U.S. Pat. No. 4,111,331 relates to a tamper-proof container closure device having a closed cap member and a crimping ring. The closed cap member is internally threaded and has a flared annular skirt extending around its base. The crimping ring is sapped into a retained position on the flared annular skirt before the cap is screwed onto a container. After the cap is screwed onto a container, the crimping ring is deformable radially inward around a suitable boss at the container opening onto which the container closure device is installed, thereby drawing the flared annular skirt into sealing engagement with the p eriphery of the boss and preventing removal of the cap without first visibly tearing off the ring.

U.S. Pat. No. 4,073,398 relates to a rabbet arrangement provided on the ring and lock element to positively prevent their relative disengagement, which would otherwise be caused by internal container pressure, once the snap-lock mechanism is installed on the container. This arrangement includes a first rabbet having a flange surface that faces axially inwardly of the container and is form ed on the right. The second rabbet, shaped to mate in interlocking engagement with the first, has a flange surface facing axially outwardly of the container and is formed on the lock element thus, when the lock element is engaged on the ring, the respective rabbets are interlocked. The respective rabbet flanges are faced so that the lock element may not be forced axially outwardly of the ring under the influence of internal container pressure, an accidental impact or other cause. The configuration of the bead embracing ring and the lock element make the device pressure tight.

U.S. Pat. No. 3,971,488 relates to a tamper proof screw cap for a container which may be locked in place on the container spout, including a lock-band surrounding the cap and having one-way teeth thereon engageable with one-way teeth surrounding the spout which permits the cap to be screwed into place but prevents the cap from being unscrewed until said lock-band is removed.

U.S. Pat. No. 3,656,648 relates to a composite closure of a flexible plastic fitment and a gasketed rigid metal closure panel. The metal closure panel is retained within the fitment by a circumferential shoulder. A lifting ring in the top of the flexible plastic fitment is joined to marginal portions of the fitment panel by breakable bridging portions and by a substantially unbreakable integral hinge portion attached directly to a portion of the skirt.

Once the breakable bridging portions are broken, the semidetached ring serves to alert shoppers that the closure has been previously tampered with or removed. The exterior face of the downwardly extending skirt of the plastic fitment is substantially straight, and extends to tight abutment with a shoulder on the container making it difficult to pry the fitment off the container with an ordinary knife blade.

U.S. Pat. No. 3,693,820 relates to a safety closure having a snap-on cap which is held in place on a container by a rotary safety ring and which cannot be removed without first removing the ring from the cap. The ring is locked to the cap by a plurality of flexible fingers which prevent the ring from being removed from the cap unless the ring is first precisely aligned in a preselected position relative to the cap, but which allows the ring to be repositioned around the cap and locked thereto without first prepositioning the ring in any particular rotary position relative to the cap.

It has been found that prior art closures which incorporate a metal crimp ring are generally incompatible with plastic container recycling programs as metal crimp rings cannot be recycled with plastic and must be physically removed. Moreover, the metal crimp rings may be subject to corrosion and contamination. Accordingly, an all plastic closure manufactured from the same type of plastic resin as the plastic container, is compatible with plastic recycling and is not susceptible to corrosion.

Accordingly, it is an object of this invention to provide an improved closure assembly and method of fabricating same.

It is also an object of this invention to provide an improved cap releasably securable with a spout.

The broadest aspect of this invention relates to a lock ring connected to a cap by a breakable web, said cap releasably securable to a spout connected to a container, whereby said lock ring is breakably displaceable from said cap to lock said spout to said container.

Another aspect of this invention relates to a closure for a container having an opening presenting an upstanding circular bead, said closure comprising: a closure body presenting a spout for dispensing liquids from said container, said spout including an annular recess for engagement with said bead; a cap releasably securable to said spout; a lock ring frangibly connected to said cap, said lock ring aligned with said closure body, said annual recess and said bead, said lock ring frangibly breakable from said cap to lock said closure body to said container.

Yet another aspect of this invention relates to a method of assembling a closure to a container having an opening presenting an upstanding bead, said method comprising the steps of: releasably securing a cap to a spout, said cap having a lock ring frangibly connected to said cap, and said spout including an annular recess registerable with said bead; placing said spout in alignment over said bead; pressing said cap so as to press-fit said bead to said annular recess; further pressing said cap so as to break said locking ring from said cap to lockingly embrace said spout against radial displacement from said bead.

DRAWINGS

These and other objects and features of the invention shall now be described in relation to the drawings.

DESCRIPTION OF THE INVENTION

Like parts shall be given like numbers throughout the figures.

Figure 1:
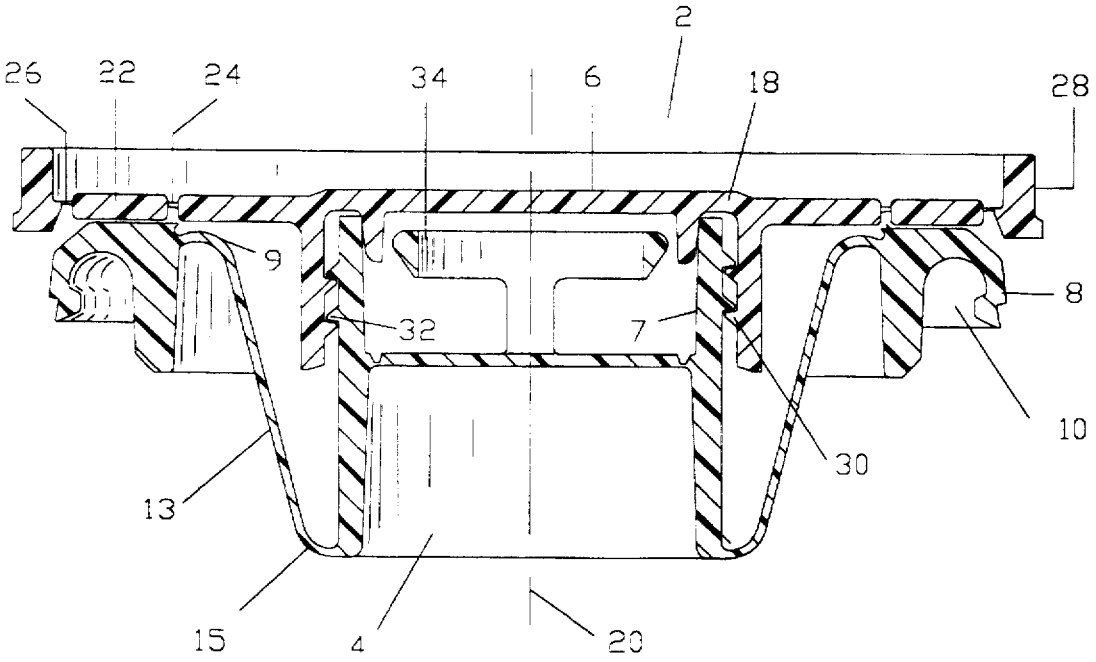
FIG. 1 is a cross-sectional view of the closure with the plastic ring shown in the open position.
Figure 2:
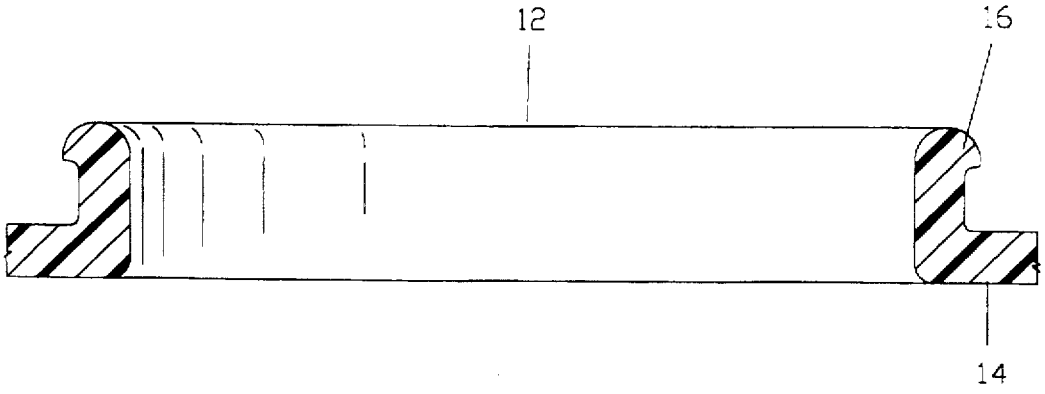
FIG. 2 is a cross-sectional view of a plastic container cover opening.

FIG. 1 is a full cross-sectional view through a closure which is generally indicated by the numeral 2. The closure 2 generally comprises a spout, or closure body 4 made of flexible plastic or the like as well as a cap 6.

Closure body 4 includes a nozzle 7, which may be predominantly cylindrical, a skirt 8 leading to nozzle 7, that skirt folding to a re-entrant position when closure 2 is in its storage position, and movable to a funnel-like extended position for feeding nozzle 7. Skirt 8 has upwardly facing extension leading to flexible downwardly facing arc 9, which leads to slope 13 and upwardly facing arc 15. In the extended position of closure body 4, slope 13 has the form of a truncated conical section, the narrow upper end, arc 15, giving onto nozzle 7 and the wider, opposite end, arc 9, giving onto extension of skirt 8. Skirt 8 includes an annular recess 10 which is adapted to be secured to an opening 12 of a container 14 which is partially shown in the figures. The lower, outer wall of annular recess 10 of depending skirt 8 is provided with a catch, in the form of an inwardly cantilevered lip 11, adjacent the lower end of skirt 8. The container 14 presents opening 12 having a generally upstanding peripheral edge with an outwardly bulbous bead 16 adapted to be received or captured by the annular recess 10 in a manner to be more fully described herein.

Cap 6 includes a generally circular cover 18 which is co-axially disposed relative to the spout, or closure body 4 about axis 20. Cap 6 also includes two bails 22 which are hingedly connected to the cap cover 18 at two points 71, and by a first, or inner set of frangible membranes 24.

Cap 6 also includes a circular locking ring 28 disposed, initially, about the periphery of bails 22 and connected thereto, and to cap 6 generally, by means of a second, or outer set of frangible membranes 26.

Cap 6 is threadably securable to the spout, or closure body 4 by means of the internal threads 30 which mate with the external threads 32 presented by the spout.

Closure 4 is made from flexible low density polyethylene plastic such that the spout may be pulled upwardly as viewed in FIG. 1 by means of breaking tamper evident frangible membranes 24 and pulling on the bails 22 in a manner well-known to those persons skilled in the art. The spout is opened by removing cap 6 and by pulling up on pull tab ring 34 as is also well known in the art.

The container 14 may be made of plastic or steel in a manner well known to those persons skilled in the art, and is provided with an upstanding flange and having a distal circumferential bead 16.

Figure 7:
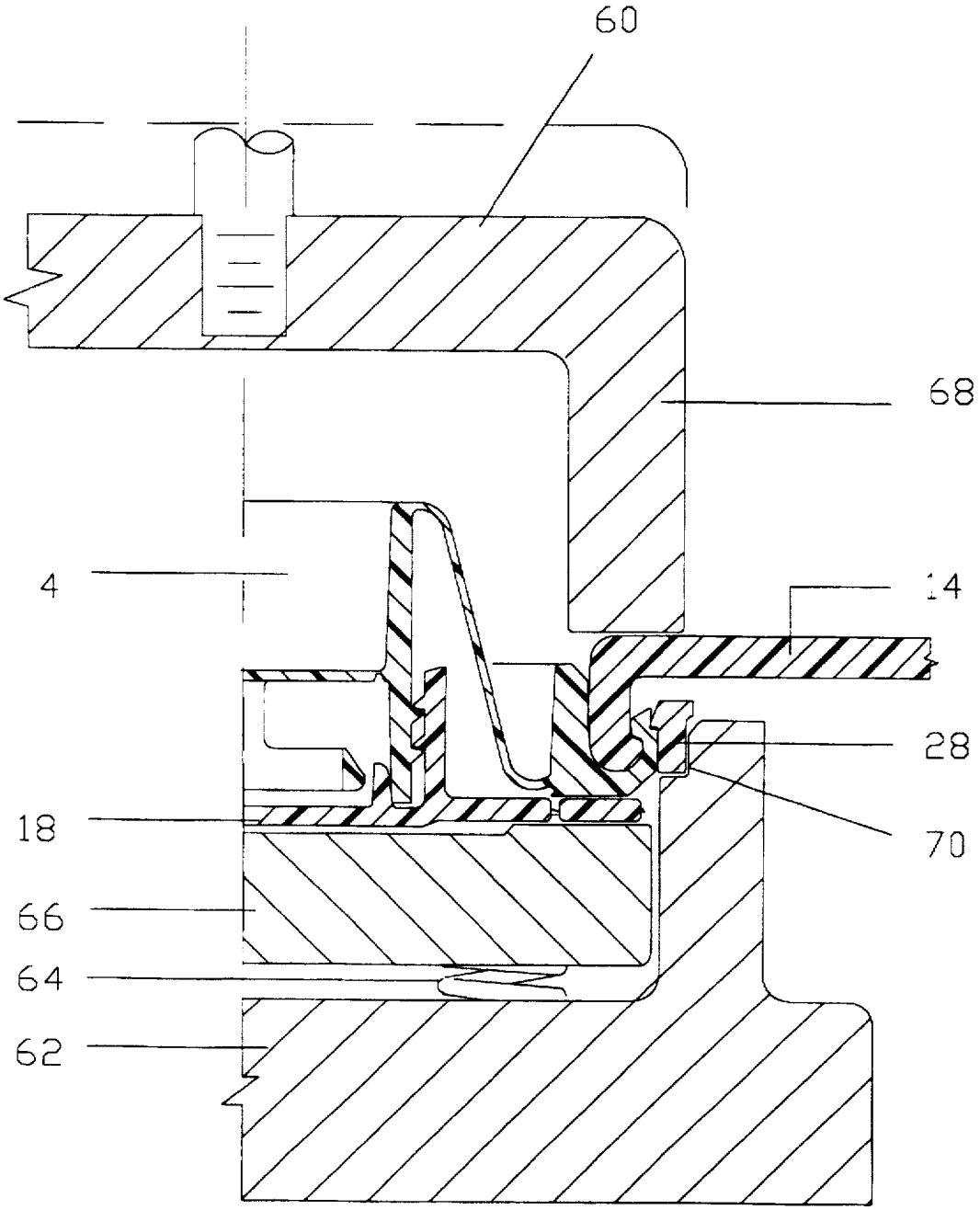
FIG. 7 is a partial sectional view of the assembly method.

FIG. 7 shows alternate bead constructions which are utilized.

Figure 3:
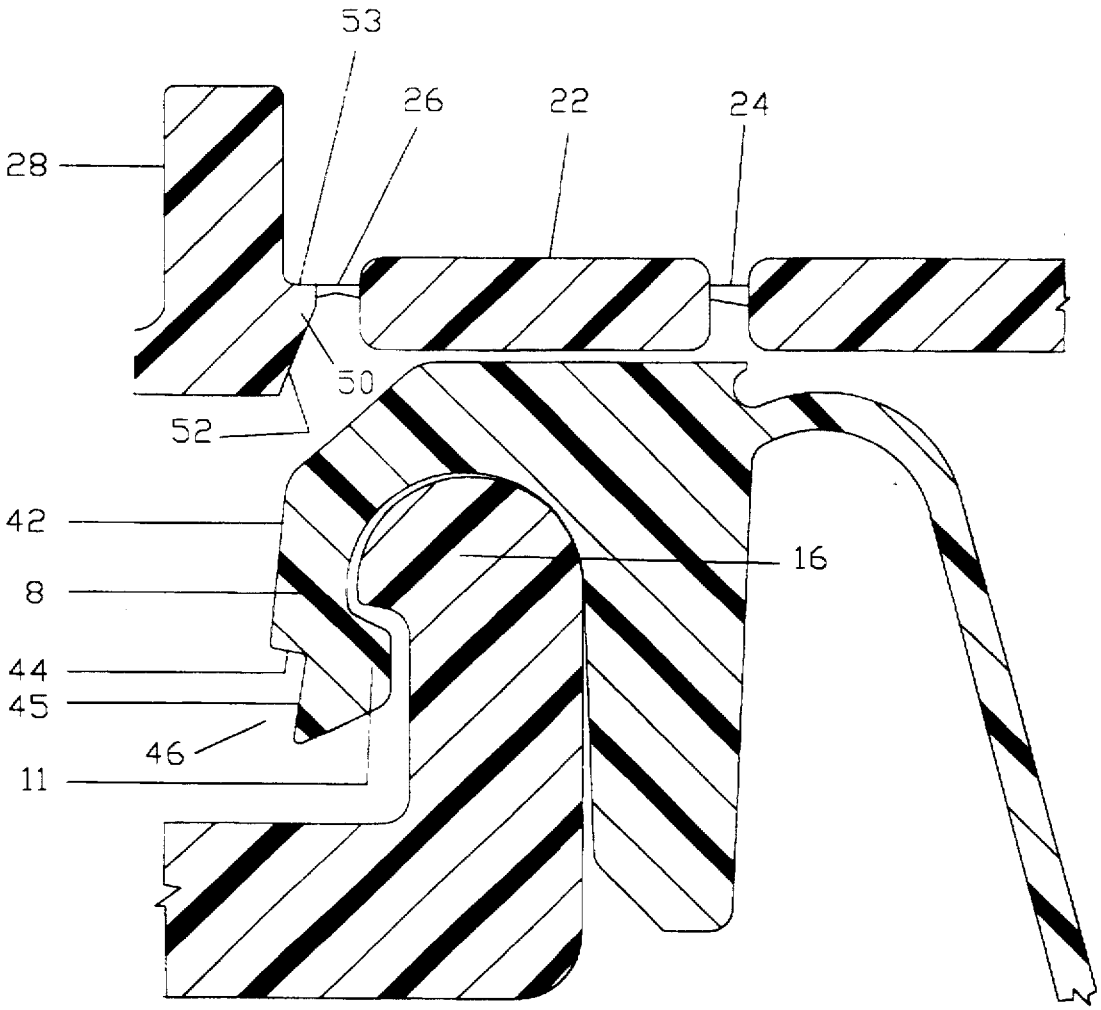
FIG. 3 is a detailed sectional view of the plastic closure partially installed on a plastic container cover with a lock ring in the open position.

FIG. 3 illustrates the first step of the installation stage whereby the body of skirt 8 has been pressed down over bead 16 of the upstanding peripheral edge of opening 12.

In particular, skirt 8 includes an outwardly facing, frustoconical, first sloped surface 42 and a rabbet, or catch 46 having a downwardly facing annular shoulder 44 and a second, outwardly facing frustoconical, or sloped surfaces 45 depending from the inner radial edge of shoulder 44. Locking ring 28 is frangibly connected to bails 22 by means of second, outer frangible membranes 26. In particular, the locking ring 28 comprises a locking projection 50, also referred to as a rabbet lock. Locking projection 50 includes an inwardly facing frustoconical sloped surface 52 and an upwardly facing shoulder 53. Rabbet lock is adapted to brace into catch 46 with surface 52 in interference fit with slope surface 45 and shoulder 53 in interference fit 82 with and under shoulder 44. In this position it is intended that locking ring 28 circumferentially braces skirt 8 of the spout. Locking ring 28 is discouraged from easy removal by engagement of shoulder 53 of locking projection 50 under annular shoulder 44.

Figure 6:
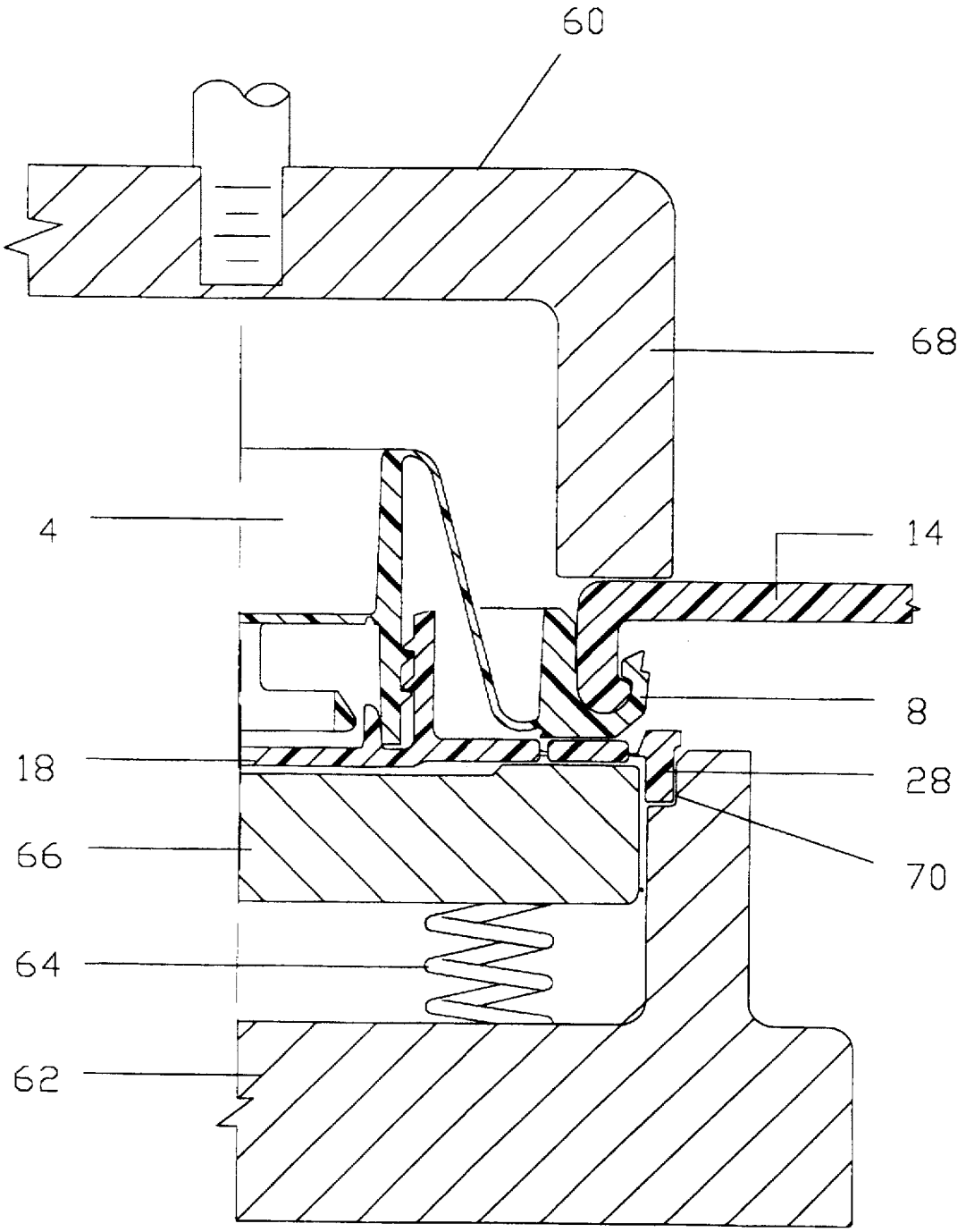
FIG. 6 is a partial sectional view of the assembly method.

FIG. 6 illustrates the use of a press 60 having a base 62 with a floating plate 66 and spring 64 for installing closure 2 to a separable cover of container 14. The press 60 includes an upper ram 68 which is displaceable by conventional means.

In installing closure 2, separable cover of container 14 is placed in alignment into press 60 along with closure 2. In particular, closure 2 has threaded cap 6 threaded to closure body 4 whereby locking ring 28 is pre-aligned with respect to body of skirt 8. Thereafter, closure 2 is aligned with respect to bead 16 and the press 60 activated so that ram 68 presses the components causing bead 16 to be received by annular recess 10. It necessarily follows that the action of press 60 as compels skirt 8 to engage, stretch outwardly over, and to capture bead 16. The most deformed position will occur when forcing lip 11 to ride over bead 16. Once beyond bead 16, lip 11 is able to contract inwardly to an at least partially relaxed position, tending to capture bead 16 and result in sealing engagement of annular recess 10 about bead 16.

Base 62 includes a locking ring recess 70 which is adapted to register with locking ring 28. Upon further activation of press 60, separable cover of container 14, spout, or closure body 4 and cap 6 are displaced relative base 62 whereby spring 64 is contracted causing the second, outer frangible membranes 26 to break thereby permitting the locking ring 28 to be displaced parallel to axis 20 in the direction indicated by arrow 'A' in FIG. 4. This causes the locking ring 28 to engage skirt 8 as best illustrated in FIGS. 4 and 7.

By utilizing cap 6 with locking ring 28 frangibly connected thereto the locking ring 28 may be quickly and easily aligned and assembled relative to closure 2 as illustrated herein.

Figure 4:
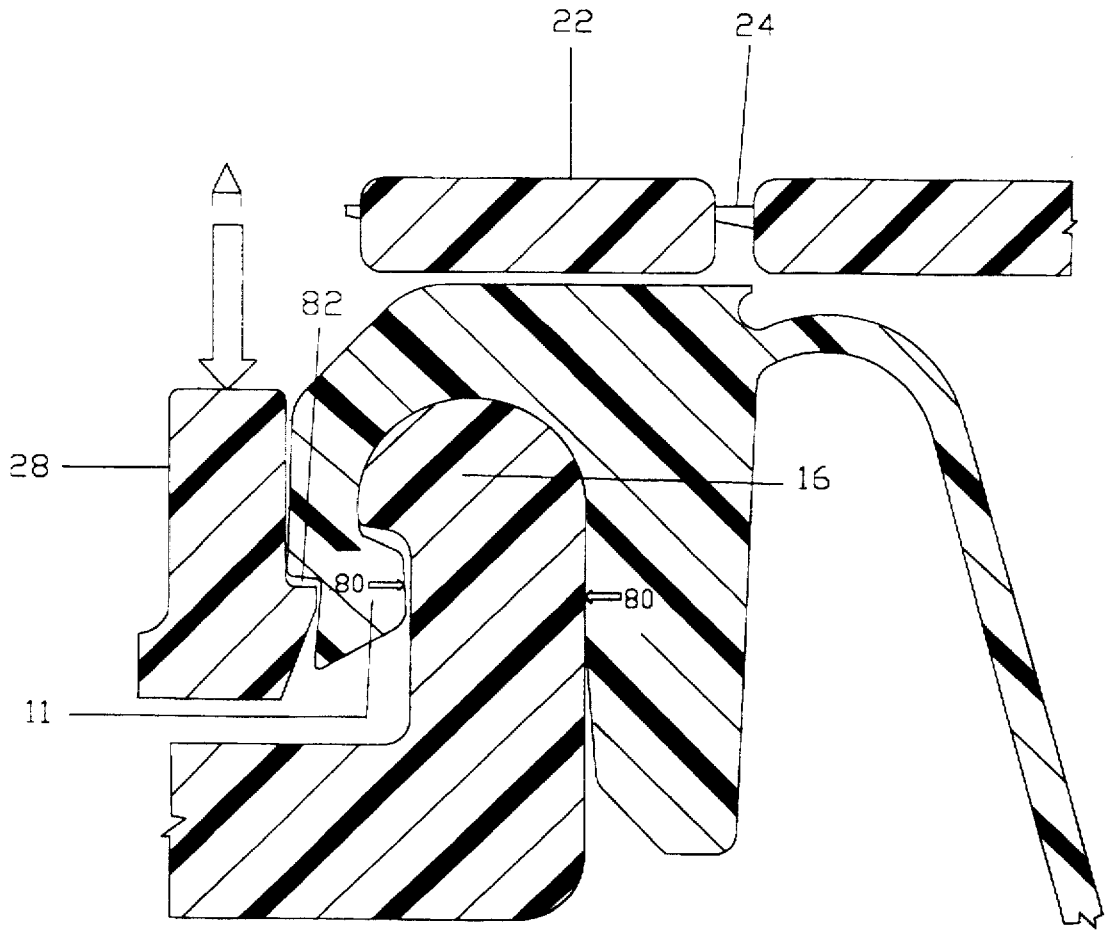
FIG. 4 is a detailed sectional view of the plastic closure in the locked position.
Figure 5:
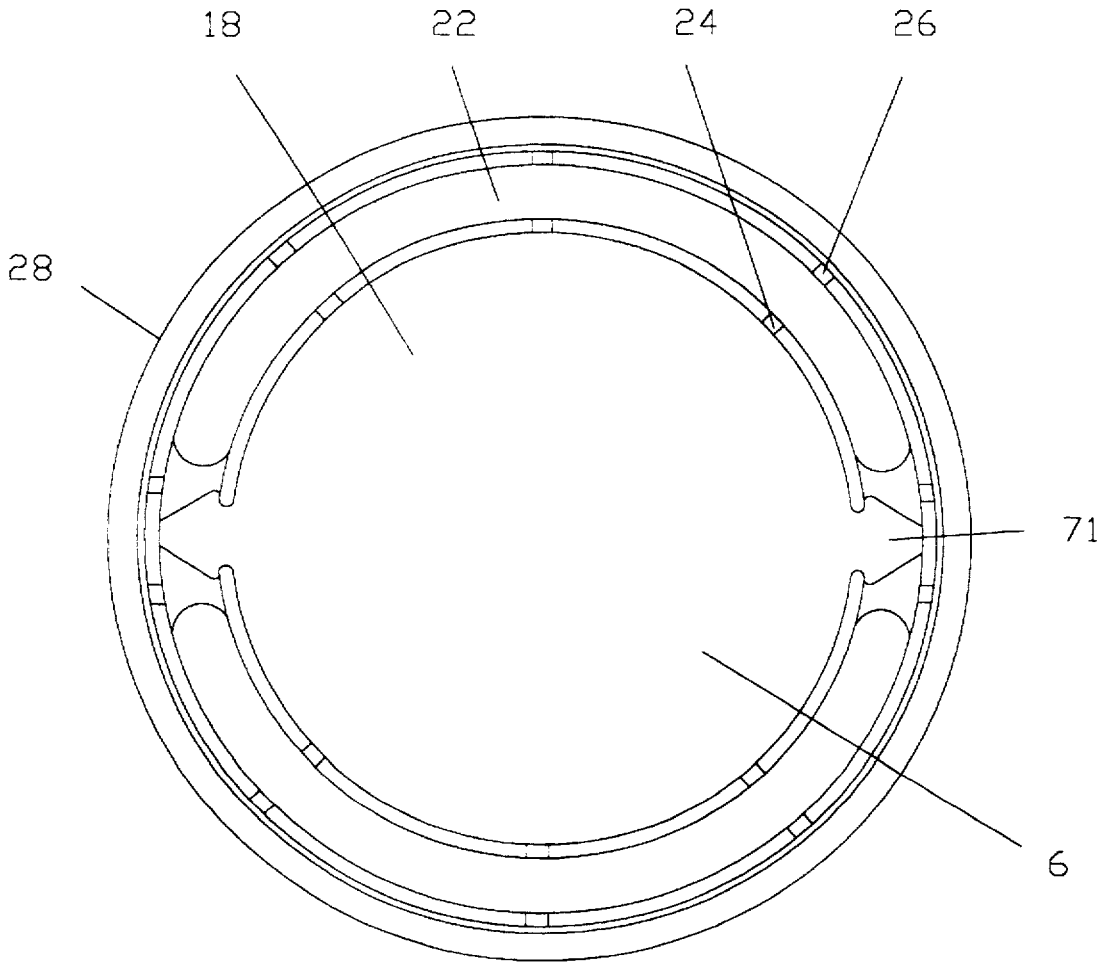
FIG. 5 is a plan view of the cap.

In particular, the closure body or skirt 8 includes an interference at points 80 as well as a locking fit 82 as best illustrated in FIG. 4.

Moreover, closure body or skirt 8 is comprised of flexible plastic so as to have sufficient flexibility for the skirt to flex and capture bead 16 in the upper portion of recess 10 while lip 11 rests below said capture forming outer most interference fit 80 as is illustrated in FIG. 4.

Cap 6 and locking ring 28 are comprised of more rigid high density plastic material to more securely lock the assembly thereto.

Figure 8:
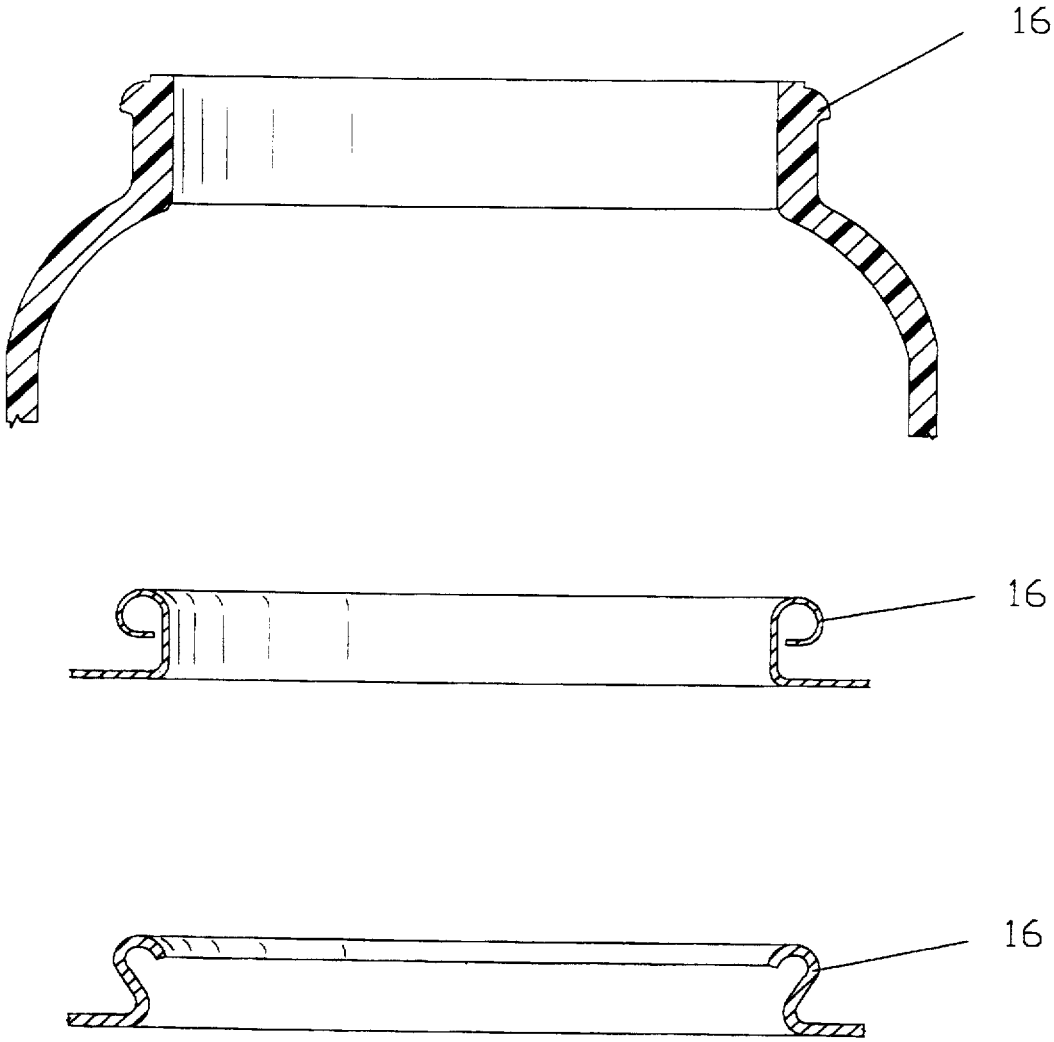
FIG. 8 illustrates alternative bead openings.

FIG. 8 illustrates alternative bead configurations that may be captured by annual recess 10.

Locking ring 28 is molded integrally with threaded cap 6. Locking ring 28 is frangibly connected to threaded cap 6 by second, outer, frangible membranes 26. Plastic locking ring 28 and threaded cap 6 are assembled to closure body 4 by screwing cap 6 thereonto. When threaded cap 6 and closure body 4 are assembled, plastic locking ring 28 is held by cap 6 above closure body 4 and in alignment therewith. Plastic locking ring 28 is then in a first, open position. The initial, open position of locking ring 28 allows skirt 8 to stretch outwardly over bead 16.

The bracing of locking ring 28 about skirt 8 provides sealing engagement of, and securement against dislocation of, closure 2 from the container 14.

Figure 9:
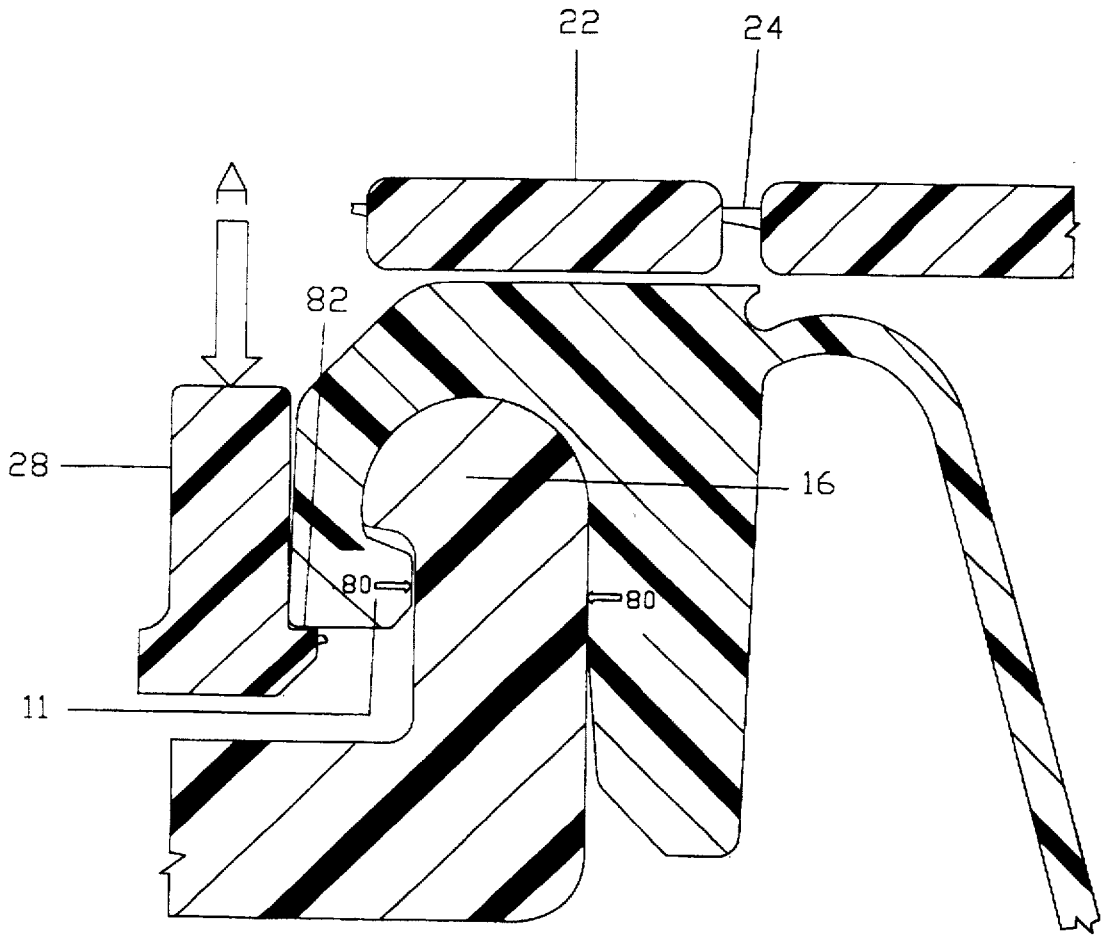
FIG. 9 illustrates alternative locking configurations.

FIGS. 3 and 4 show rabbetted locking arrangements while FIG. 9 shows an alternate embodiment with the locking projection of locking ring 28 disposed below skirt 8.

The foregoing discloses a flexible pouring spout closure for containers with plastic locking ring for securing the closure to a container which has an annular bead about the opening periphery, the closing having: a flexible pour spout body element with an axially extending annular recess which is open at one extreme of its axial extent to receive the container bead; the recess being shaped so that the body recess tightly embraces the bead when received in the recess. The annular rib is adjacent the open margin of the body element recess, which underlies at least a portion of the bead when received in the recess. There is a cap element with an internally molded thread for engagement and alignment with the body element; two bails for extending the pouring spout neck, and a locking device initially interconnected to the cap and bails by frangible membranes in a position axially displaced from said body element skirt, the locking device being engageable on the body element skirt after installation of the closure body on the container bead. The locking device exerts a radial force on the skirt into secured sealing engagement with the container bead, and retains the inwardly facing lip in underlying relation to the bead.

The body element may be made of a single piece molded plastic construction of low density polyethylene or the like. The cap element and locking device is initially of a single piece molded plastic construction of high density polyethylene or the like.

Although the preferred embodiment as well as the operation and the use have been specifically described in relation to the drawings, it should be understood the variations in the preferred embodiment could be achieved by a man skilled in the art without departing from the spirit of the invention. Accordingly, the invention should not be understood to be limited to the exact form revealed by the drawings.

The embodiments of the invention in which an exclusive property or privilege is claimed are defined as follows:

1. A cap and a locking ring, that cap and locking ring for use with a container having a spout, that container having an opening with a bead, that spout being connected to said bead and having a skirt at the base of this connection wherein:

(a) said locking ring is formed integrally with and coaxially aligned with said cap:

(b) said locking ring is joined to said cap by at least one frangible membrane:

(c) said locking ring is breakable and displaceable from said cap to capture the skirt of said spout which is connected to said opening of the container: and (d) whereby said locking ring captures said skirt to brace the connection between said spout and bead.

2. The cap and locking ring of claim 1 wherein the spout is disposed about an axis, and said locking ring is coaxially aligned to register with the spout to lock the spout to the container.

3. The cap and locking ring of claim 1 wherein:

said at least one frangible membrane is a radially outer frangible membrane;

said cap comprises at least one bail formed integrally therewith and joined thereto by a hinge and by at least one, inner frangible membrane extending radially inwardly from said at least one bail;

said locking ring is formed integrally with said cap, and in a first position is disposed about said bail and joined thereto by said at least one, outer, frangible membrane extending radially outwardly from said bail;

said cap, said spout, and said bail are co-axially aligned with said beaded rim; and said locking ring is concentrically disposed about, and initially joined by said at least one frangible membrane to said bail.

4. A closure for a container comprising the cap and locking ring of claim 1, and the spout recited in claims 1 wherein:

said skirt is movable from a first, undeformed position in which said recess is disengaged from said bead to a second, most deformed position in which said first catch rides over said bead, and thence to a third, partially relaxed position in which said first catch captures the said bead; and said locking ring is movable to a locking position, in said locking position said locking ring seating about said skirt adjacent said bead whereby said catch is prevented by said locking ring from returning to said second position.

5. A closure for a container, that container having an opening presenting an upstanding circular bead, said closure comprising:

(a) a spout for dispensing liquids from the container, said spout including an annular recess for engagement with said bead;

(b) a cap releasably securable to said spout;

(c) a locking ring connected by a frangible membrane to said cap, said locking ring alignable with said spout, said annular recess and said bead; said locking ring movable from a first position in which it is joined to said cap by said membrane, to a second position in which to lock said closure spout to said container.

6. A closure as claimed in claim 5 wherein said cap includes a cap cover, a bail connected to said cap cover, and said locking ring is frangibly connected to said bail.

7. A closure as claimed in claim 5 wherein said spout includes a circumferential skirt presenting said annular recess to said bead.

8. A closure as claimed in claim 7 wherein:

said skirt presents an outwardly facing notch, and said locking ring includes an inwardly facing locking projection for engagement therein.

9. A closure as claimed in claim 8 wherein said cap includes a bail and said locking ring is frangibly connected to said bail by at least one frangible membrane.

10. A closure as claimed in claim 9 wherein said frangible membrane is approximately 20 thousandths of an inch thick, and 50 thousandths of an inch wide circumferentially.

11. A closure as claimed in claim 10 whereby said spout is comprised of flexible plastic and said cap is comprised of rigid plastic.

12. A cap for a spout and a locking ring, said spout having a skirt connected about an opening of a container;

said locking ring frangibly connected to said cap;

said cap and locking ring coaxially aligned with said spout and said opening;

said locking ring separable from said cap and moveable to capture said skirt to lock such spout to said container.

13. A cap and a locking ring, for use with a container having a spout, that container having an opening with an outwardly facing bead, that spout having a skirt with a recess for receiving the bead and a deformable first catch inwardly facing lip, that lip is slidable over and beyond the bead of said container where it rests in a partially relaxed position and the bead rests in said recess, wherein:

(a) said locking ring is formed integrally with and co-axially aligned with said cap;

(b) said locking ring is joined to said cap by at least one frangible membrane;

(c) said locking ring is breakable and displaceable from said cap and slidable over and locking with said inwardly facing skirt of said spout;

(d) said displaced locking ring radially locks said radially inwardly facing skirt lip and bead registering with said recess;

(e) whereby said spout is secured to said container and said spout includes an exterior thread; and (f) said cap includes an interior thread registerable with said exterior thread of said spout as a means of accessing and sealing contents of said container.

* * * * *